US006981396B1

(12) United States Patent
Kim

(10) Patent No.: US 6,981,396 B1
(45) Date of Patent: Jan. 3, 2006

(54) EXCHANGEABLE LOCK CONSTRUCTION

(76) Inventor: Jung Kyu Kim, 1223-6 Sangkeok-4Dong, Buk-ku, Taegu (KR) 702-014

( * ) Notice: Subject to any disclaimer, the term of this patent is extended or adjusted under 35 U.S.C. 154(b) by 0 days.

(21) Appl. No.: 10/904,129

(22) Filed: Oct. 25, 2004

(51) Int. Cl.
*E05B 9/04* (2006.01)
*E05B 27/04* (2006.01)

(52) U.S. Cl. ..... 70/495; 70/369; 70/371

(58) Field of Classification Search ..... 70/419, 70/421, 367–371, 494–496
See application file for complete search history.

(56) References Cited

U.S. PATENT DOCUMENTS

| | | | | |
|---|---|---|---|---|
| 2,145,085 | A * | 1/1939 | Heyer | 70/421 |
| 2,194,959 | A * | 3/1940 | Voight | 70/419 |
| 2,426,104 | A * | 8/1947 | Johnstone | 70/421 |
| RE31,910 | E * | 6/1985 | Oliver | 70/369 |
| 4,655,063 | A * | 4/1987 | Foshee et al. | 70/419 |
| 5,421,179 | A * | 6/1995 | Bergstrom | 70/369 |
| 5,507,163 | A * | 4/1996 | Juang | 70/369 |
| 5,615,566 | A * | 4/1997 | Brandt | 70/419 |
| 5,813,260 | A * | 9/1998 | Widen | 70/369 |
| 6,301,942 | B1 * | 10/2001 | Shvarts | 70/367 |
| 6,477,876 | B1 | 11/2002 | Kim | 70/495 |
| 6,526,791 | B2 * | 3/2003 | Shvarts | 70/419 |
| 6,718,807 | B2 * | 4/2004 | Andersson | 70/371 |
| 6,871,520 | B2 * | 3/2005 | Armstrong et al. | 70/492 |

* cited by examiner

*Primary Examiner*—Lloyd A. Gall
(74) *Attorney, Agent, or Firm*—Park&Sutton LLP; John K. Park

(57) ABSTRACT

Disclosed is an exchangeable lock construction, which a main body assembly having a casing, a rolling body and an tubular operation body is inserted into a fixed body, and which the main body assembly can be separated from the fixed body by a key. The lock construction includes a slide bar supported by the spring in a lateral direction of the rolling body, and a plurality of slide pins respectively having receiving grooves formed thereon in such a manner as to located at different positions and heights thereon, the slide pins being aligned by a side waved portion of the key, wherein the tubular operation body further has an elongated operation hole formed at a side thereof for allowing the slide bar to slidably pass therethrough, and the casing has a locking groove formed on the inner periphery thereof for locking the outer side end of the slide bar therein.

3 Claims, 5 Drawing Sheets

EXCHANGEABLE LOCK CONSTRUCTION

BACKGROUND OF THE INVENTION

1. Field of the Invention

The present invention relates to a lock construction which is mounted on a door lock and operated by insertion of a key, and more particularly, to an exchangeable lock construction capable of being assembled to and disassembled from the door lock, thereby effectively preventing separation of the lock construction or unlocking of the door lock through the use of various pseudo keys, but not a correct key suitable for the lock construction, for unfair purpose.

2. Background of the Related Art

Recently, various countermeasures have been taken to prevent unlocking of a door lock for the purpose of criminal acts. As one of them, a lock construction mounted on a door lock is assemblable and disassemblable by an exchangeable key. For example, in case of a door lock for a lodging house, there occasionally occurs a case where a lodger copies a key during lodging, and then, opens the door lock of the corresponding room using the copied key after leaving the lodging house for the purpose of criminal acts. Therefore, to prevent the crime, an owner of the lodging house mounts a door lock with a separable lock construction, and then, exchanges the lock construction with another lock construction of different lodging room, if necessary.

However, the above lock construction cannot prevent unlocking by means of pseudo keys for unlocking a lock (keys that a key mechanic uses for unlocking a lock by controlling the inner pins one by one without a correct key to open a door if a user lost the correct key, but they are occasionally used for the purpose of crime), but not the copied key.

Meanwhile, there is another countermeasure that has been taken to prevent illegal unlocking of the door lock. That is, a general lock construction, which cannot be separated from the door lock, includes a side waved portion formed on a side of a key to reinforce security, and a slide bar for rotating an inner rolling body or preventing the rotation of the inner rolling body by the side waved portion.

As an example of the above lock construction, there is disclosed U.S. Pat. No. 6,477,876 in which as shown in FIG. 6, a side waved portion 101 is formed on a side of a key 100, a plurality of rectangular slide pins 120 are mounted in an inner rolling body 110, the rectangular slide pins formed at one side with grooves 121 horizontally arranged by the side waved portion 101, and a slide bar 130 is centrally pushed when the inner rolling body 110 is rotated by the arrangement of the grooves 121.

Therefore, such a lock construction can be unlocked only when an upper waved portion 102 of the key 100 aligns associated elements of the lock construction and the side waved portion 101 of the key 100 also aligns other associated elements of the lock construction, and hence can further increase security as compared with a general lock construction.

There has been an attempt to apply the security reinforcing structure by virtue of the slide bar to a door lock with an exchangeable lock construction. However, for an exchangeable lock structure (structure in which a tubular operation body is locked to the inner periphery of a fixed body or unlocked from the inner periphery while being rotated when a key is inserted and turned) by virtue of an tubular operation body among various constitutional means for exchanging the locking construction, because the tubular operation body surrounds the rolling body, the slide bar cannot be mounted.

As a result, the exchangeable lock construction with the tubular operation body is weaker in security than other exchangeable lock constructions.

The present invention is aimed at combining the exchangeable lock construction using the tubular operation body with a structure in which the slide bar is operated by a side waved portion of a key, so as to further reinforce security and reliability of such an exchangeable lock construction. Furthermore, the present invention is aimed at reinforcing security by virtue of operation of the slide bar and preventing damage of the lock construction by means of a drilling machine.

SUMMARY OF THE INVENTION

Accordingly, the present invention has been devised in order to solve the above problems occurring in the prior art.

An object of the present invention is to provide a lock construction, in which a lock construction structure using an tubular operation body is combined with a security function by virtue of a slide bar operated by a side waved portion of a key, thereby further increasing security and preventing random operation of the slide bar in spite of a little error through a more accurate operation of the slide bar.

In more detail, the lock construction according to the present invention includes an outer fixed body which is fixed after being inserted into a door lock, and a main body assembly inserted into the fixed body or separated from the fixed body. The main body assembly can be separated from the fixed body by a key manufactured suitably for replacement of the lock construction.

The main body assembly includes a casing, an tubular operation body mounted inside the casing for allowing the main body assembly to be assembled to or disassembled from the fixed body by a function of the key, and a rolling body for locking or unlocking the door lock while rotating by the turning of the key.

The casing, the tubular operation body and the inner rolling body respectively are formed with pin holes passing through their center areas for inserting pins aligned by the key thereto.

Particularly, a slide bar operated by a side waved portion of the key is mounted in the rolling body. The tubular operation body has an elongated slide operation slit formed thereon and the casing has a locking groove formed on the inner periphery thereof for operation of the slide bar.

Furthermore, a slide pin for restricting the operation of the slide bar includes a plurality of auxiliary grooves for making the operation of the slide bar impossible in spite of a little inaccurate alignment of the slide pins, and the slide bar is formed at the front end thereof with a recess to be locked in the auxiliary grooves of the slide pin.

By such an arrangement, the lock construction according to the present invention can be assembled and disassembled like the conventional separable lock constructions, and additionally provide a security function by virtue of the slide bar.

Moreover, since the slide bar of the present invention includes the recess formed at the front end thereof and the slide pin includes the auxiliary grooves formed above and below a receiving groove formed thereon, when a pseudo key, namely, a copied key is inserted into the lock construction and the inner rolling body is rotated in a state where the slide pins are not aligned precisely, the upper and lower sharpened portions of the recess of the slide bar are locked in the auxiliary grooves of the slide pin, so that the slide bar cannot be inserted into the receiving groove of the slide pin and the door lock is thus not unlocked.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

FIGS. 1 to 5 show a preferred embodiment of the present invention.

Figure 1:
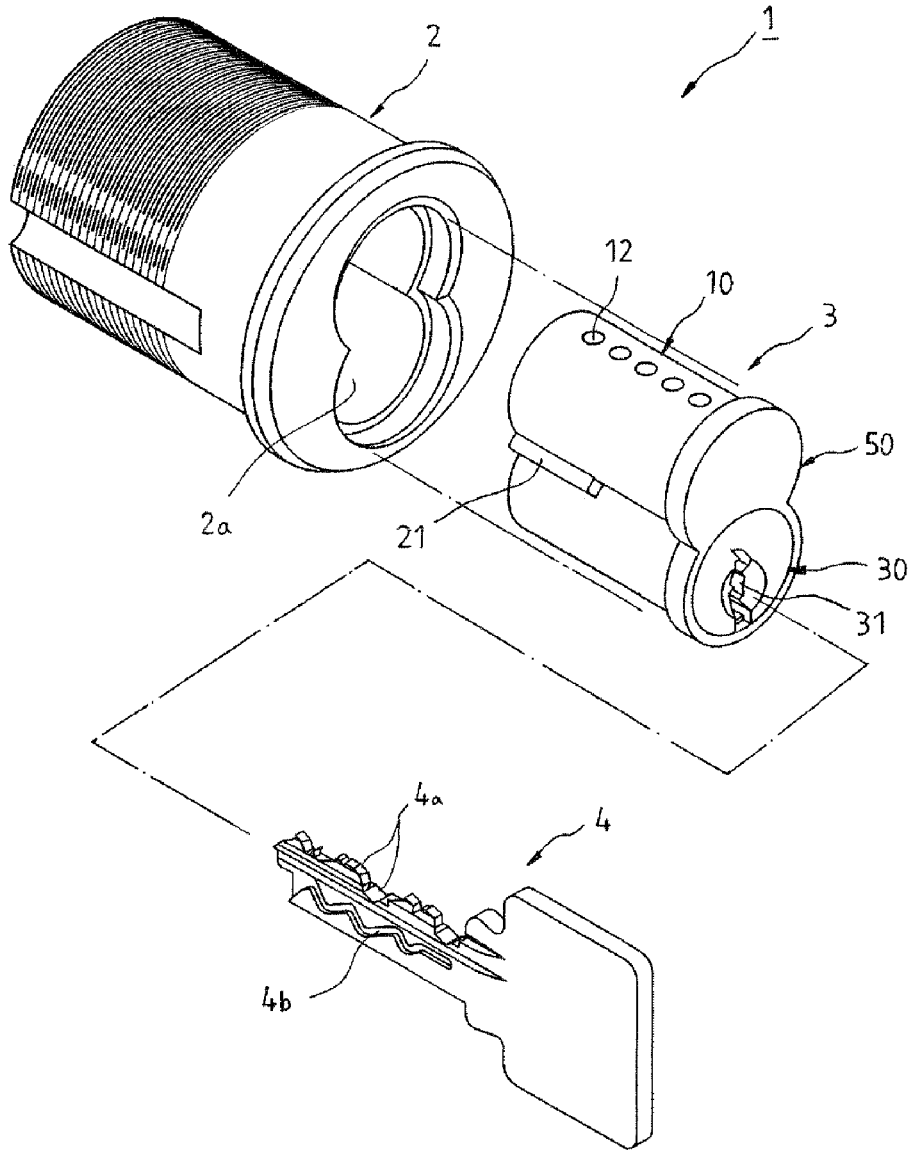
FIG. 1 is an exploded perspective view schematically illustrating a lock construction according to a preferred embodiment of the present invention.

As shown in FIG. 1, a lock construction 1 includes an outer fixed body 2 fixed to a door lock after being inserted into the door lock, and a main body assembly 3 inserted into the fixed body 2 or separated from the fixed body 2. A key 4 is inserted into a key hole 31 centrally formed in a rolling body 30 of the main body assembly 3.

In the above, a key for unlocking the door lock by rotating the rolling body and a key for separating the main body assembly 3 from the fixed body 2 by operating a tubular operation body are needed.

The main body assembly 3 is contoured to forcedly fit into an insertion hole 2*a* formed in the fixed body 2. The insertion hole 2*a* and the main body assembly 3 respectively are in a shape in which two circles are partially overlapped.

Figure 2:
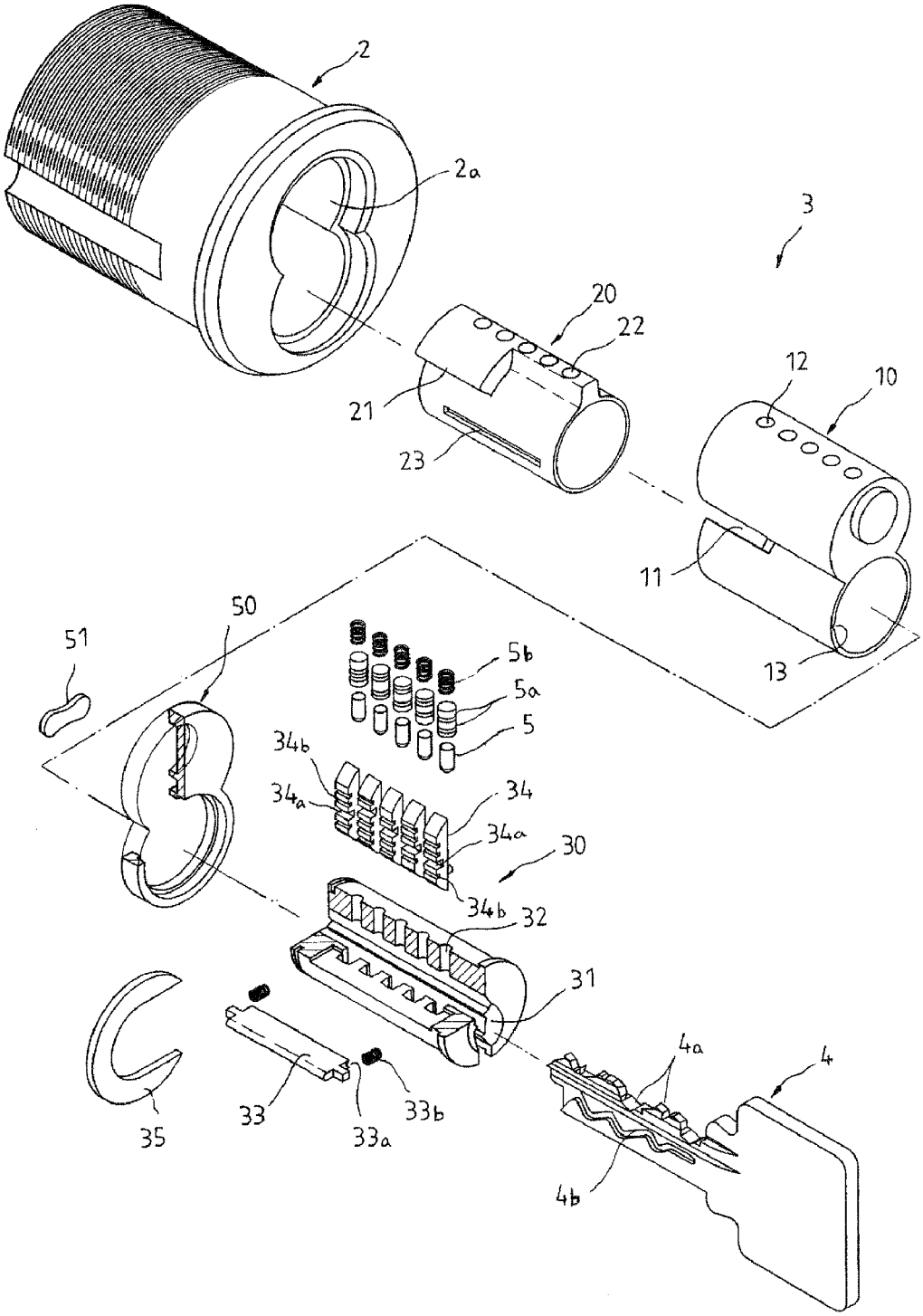
FIG. 2 is an exploded perspective view in detail illustrating a lock construction according to a preferred embodiment of the present invention.

Hereinafter, referring to FIG. 2, the main body assembly 3 will be described in more detail. The main body assembly 3 includes a casing 10 a casing contoured to properly fit into the insertion hole 2*a* of the fixed body and having an opening.

The casing 10, the tubular operation body 20 and the rolling body 30 respectively have a plurality of pin holes 12, 22 and 32 communicating with one another. Well-known pins 5, sleeves 5*a* of different heights, and springs 5*b* are inserted into the pin holes, and then, aligned by an upper waved portion 4*a* of a key 4 in such a manner as to be rotated when the key 4 is inserted into the lock construction 1.

The tubular operation body 20 has a retaining protrusion 21 formed thereon and is accommodated in the casing 10 in a rotatable state at a predetermined angle. When the tubular operation body 20 is rotated in a side direction, the retaining protrusion 21 is exposed to a retaining opening 11 of the casing 10 and locked by the inner periphery of the insertion hole 2*a*, so that the main body assembly 3 is not separated from the insertion hole 2*a*. When the tubular operation body 20 is rotated in the opposite direction to the above rotating direction, the retaining protrusion 21 is unlocked from the inner periphery of the insertion hole 2*a* and the main body assembly 3 can be separated from the fixed body 2.

Figure 3:
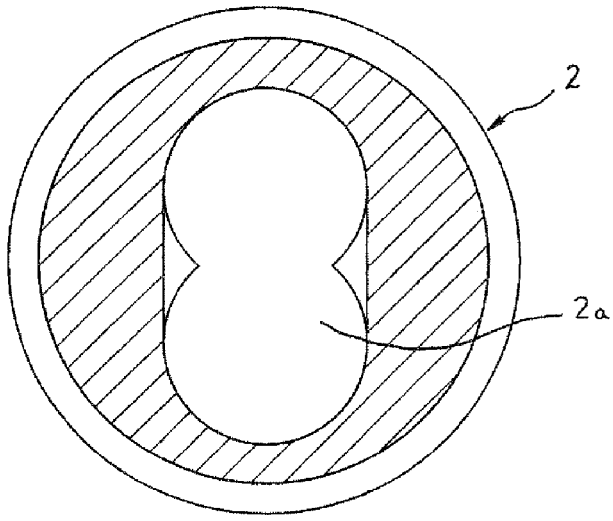
FIG. 3 is a cross-sectional view of an insertion hole of a fixed body according to the present invention.

As shown in FIG. 3, the entrance side of the insertion hole 2*a* of the fixed body 2 is in the form where two circles are partially overlapped, but the inside of the insertion hole 2*a* is in the form that two circles are connected in a straight line, so that the retaining protrusion 21 can be locked to the insertion hole 2*a*.

The inner rolling body 30 includes a slide bar 33, which is similar to what has been described in the "background of the related art" part, and which is supported by a spring 33*b*. A slide pin 34 for restricting operation of the slide bar 33 includes a receiving groove 34*a* formed thereon in such a manner as to be located at different positions, for inserting the slide bar 33 thereinto and heights thereon and a plurality of auxiliary grooves 34*b* formed above and below the receiving groove 34*a*. The slide bar 33 includes a recess 33*a* formed at the inner side end thereof in the form of a '<' shape.

The tubular operation body 20 includes an elongated operation slit 23 formed at a side thereof for allowing the slide bar 33 to slidably pass therethrough in such a manner as to be located at the same position as the slide bar 33 when being assembled, and the casing 10 includes a locking groove 13 formed on the inner peripheral portion thereof for locking the outer side end of the slide bar 33 therein.

The cover 50 includes a damage-preventing piece 51 inserted into the inner periphery just above the position where the rolling body 30 is assembled. The damage-preventing piece 51 is greatly improved in strength with a thermal treatment so as to prevent cutting.

Reference numeral 35 designates a ring for assembly, and numeral 4*b* designates a side waved portion of the key.

The function of the lock construction 1 according to the present invention will be described hereinafter in more detail.

Figure 4A:
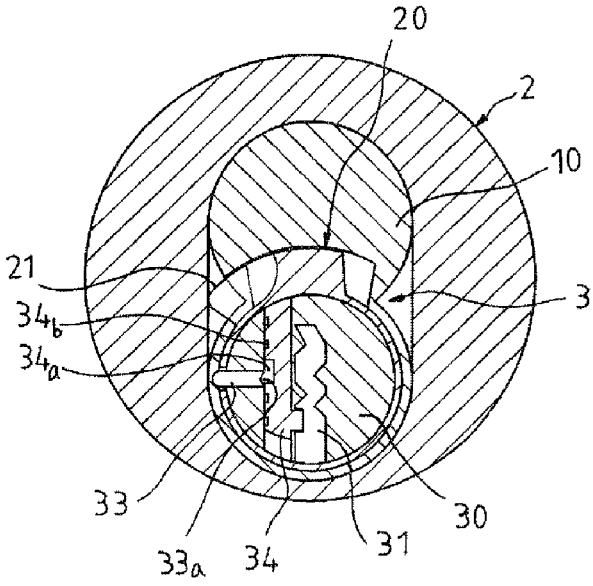
FIGS. 4*a* and 4*b* are cross-sectional views showing states before and after a slide bar is operated.
Figure 4B:
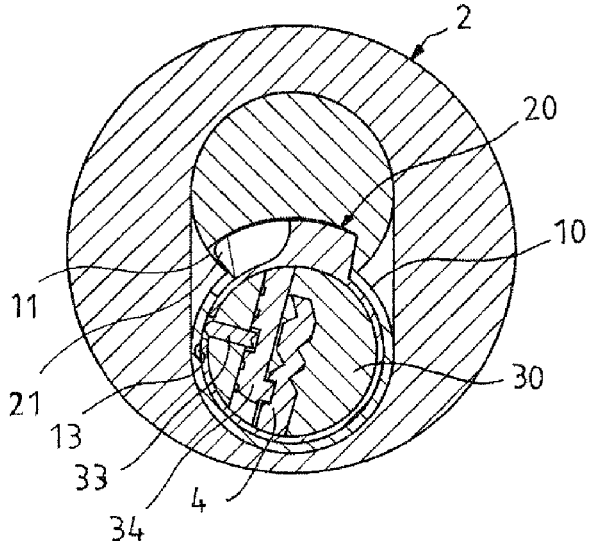

First, a function for separating the main body assembly 3 from the fixed body 2 referring to FIGS. 4*a* and 4*b* will now be described with reference to FIGS. 4*a* and 4*b*.

When the key 4 manufactured for the purpose of separation of the main body assembly 3 from the outer fixed body 2 is inserted into the key hole 31, a plurality of the slide pins 34 are aligned by the side waved portion 4*b* of the key 4, so that the receiving grooves 34*a* of the slide pins 34 are aligned in a straight line. Therefore, the inner side end of the slide bar 33 can be inserted into the receiving grooves 34*a*.

Moreover, the pins 5 and sleeves 5*a* are aligned by the upper waved portion 4*a* of the key 4. At this time, the pins 5 and the sleeves 5*a* are aligned between the casing 10 and the tubular operation body 20, so that the tubular operation body 20 can be moved in a state where the casing 10 is fixed.

By the above operation, when the rolling body 30 is rotated by the key 4 in a clockwise direction, the slide bar 33 is pushed away from the locking groove 13 formed on the inner periphery of the casing 10, while being rotated together with the rolling body 30 in a state where the inner side end of the slide bar 33 is inserted into the receiving grooves 34*a* of the slide pins 34.

Therefore, because the retaining protrusion 21 of the tubular operation body 20 is escaped from the retaining opening 111 of the casing 10 toward the interior space of the casing when the tubular operation body 20 is rotated, the entire main body assembly 3 can be separated from the insertion hole 2*a* of the fixed body 2.

When the key 4 is turned in a counterclockwise direction in a state where the main body assembly 3 is completely inserted into the insertion hole 2*a* of the fixed body 2, the retaining protrusion 21 is exposed outwardly from the outer periphery of the casing 10 through the retaining opening 11 of the casing 10 and locked to the inner periphery of the insertion hole 2*a*.

Figure 5A:
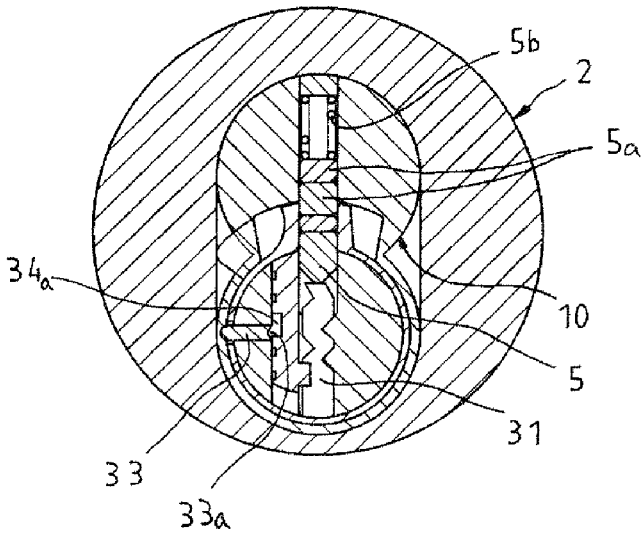
FIGS. 5*a* and 5*b* are cross-sectional views showing states before and after a door lock is unlocked through the lock construction according to the present invention.
Figure 5B:
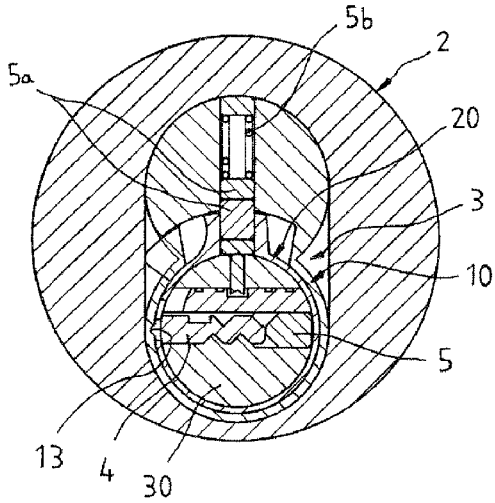
Figure 6:
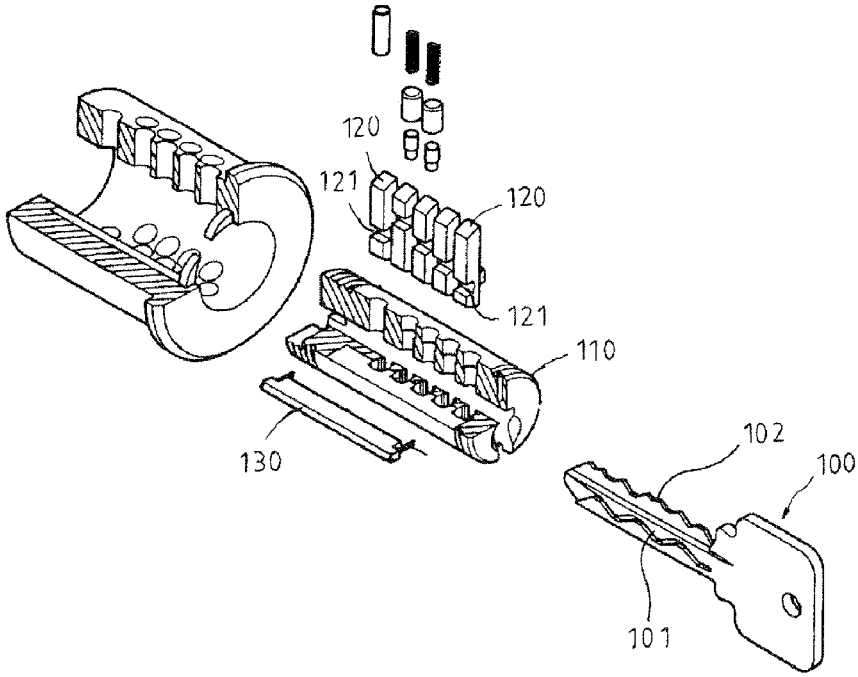
FIG. 6 is an exploded perspective view showing essential components of a conventional lock construction.

Hereinafter, the operation for unlocking the door lock by virtue of a function of the key 4 will be described with reference to FIGS. 5*a* and 5*b*.

When the key 4 manufactured for the purpose of locking and unlocking a door lock is inserted into the key hole 31, the slide pins 34 are aligned like the above principle for separating the main body assembly 3 from the fixed body 2, and at the same time, the pins 5 and the sleeves 5*a* are aligned by the upper waved portion 4*a* of the key 4. At this time, the pins 5 and the sleeves 5*a* are aligned between the rolling body 30 and the tubular operation body 20, but not between the casing 10 and the tubular operation body 20. It means that the tubular operation body 20 is not moved in engagement with the casing 10 even though the rolling body 30 is rotated.

Therefore, when the key 4 is turned in a clockwise direction, the slide bar 33 is escaped from the elongated operation slit 23 of the tubular operation body 20 and deeply inserted into the receiving grooves 34*a*, and only the rolling body 30 is completely rotated to unlock the door lock.

The present invention can prevent an error which may occurs in the course of inserting the slide bar 33 into the receiving grooves 34*a* of the slide pins 34. To this end, the slide bar 33 includes the recess 33*a* formed at the inner side end thereof in the form of a '<' shape, and the slide pin 34 includes a plurality of auxiliary grooves 34*b* formed above and below the receiving groove 34*a*. Therefore, in the case where a user tries to unlock the door lock with a copied key or a pseudo key, or to separate the main body assembly 3 for unfair purpose, when the rolling body 30 is rotated in a state where the slide pins 34 are not aligned precisely, the upper and lower sharpened portions of the receiving groove 33*a* of the slide bar 33 are locked in the auxiliary grooves 34*b* of the slide pins 34, so that the slide bar 33 cannot be slid and the door lock is not unlocked.

In the prior art lock construction, even though the receiving grooves of the slide pins 34 are aligned a little inaccurately, when the rolling body is rotated strongly, the slide bar is forcedly slid into the receiving grooves. Therefore, the present invention can further reinforce security of the lock construction as compared with the conventional lock construction.

According to the present invention, since the damage-preventing piece 51 greatly improved in strength with a thermal treatment is inserted into the inner periphery of the cover 50 where the pins 5 are aligned, any damage of the main body assembly 3 by means of the drilling machine can be prevented.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An exchangeable lock construction comprising:

an outer fixed body adapted to be inserted and fixed into a door lock and having an insertion hole internally formed in a shape where two circles are partially overlapped;

a main body assembly inserted into the fixed body or separated from the fixed body;

wherein the main body assembly includes a casing contoured to properly fit into the insertion hole of the fixed body and having an opening, an tubular operation body inserted into the rear end of the casing and having a retaining protrusion formed thereon, the tubular operating body being adapted to allow the main body assembly to be separated from the fixed body or prevent the separation of the main body assembly from the fixed body, and an inner rolling body inserted into the casing and having a key hole formed therein, the rolling body having a plurality of pin holes therein for slidably receiving a plurality of circular pins therein, each of the circular pins being in contact with a sleeve and a spring, the circular pins and the sleeves adapted to be aligned by a key while being supported by a spring; and a cover coupled to the front portion of the casing;

a slide bar supported by a spring in a lateral direction of the rolling body; and a plurality of slide pins having receiving grooves formed thereon in such a manner as to be located at different positions and heights, for inserting the slide bar thereinto, the slide pins adapted to be aligned by a side waved portion of the key, wherein the tubular operation body further has an elongated operation slit formed at a side thereof for allowing the slide bar to slidably pass therethrough, and the casing has a locking groove formed on the inner periphery thereof for locking the outer side end of the slide bar therein.

2. The exchangeable lock construction according to claim 1, wherein the slide bar includes a recess 33*a* formed at the inner side end thereof in the form of a '<' shape, and the slide pins include a plurality of auxiliary grooves formed above and below the receiving groove thereof.

3. The exchangeable lock construction according to claim 1, wherein the cover includes a damage-preventing piece inserted into the inner periphery thereof just above the position where the rolling body is assembled, the damage-preventing piece being greatly improved in strength with a thermal treatment so as to prevent cutting.

* * * * *